United States Patent [19]

Zenda

[11] Patent Number: 4,990,904

[45] **Date of Patent: * Feb. 5, 1991**

[54] DISPLAY MODE SWITCHING SYSTEM FOR FLAT PANEL DISPLAY APPARATUS

[75] Inventor: Hiroki Zenda, Hamura, Japan

[73] Assignee: Kabushiki Kaisha Toshiba, Kawasaki, Japan

[ * ] Notice: The portion of the term of this patent subsequent to Feb. 5, 2008 has been disclaimed.

[21] Appl. No.: 208,130

[22] Filed: Jun. 17, 1988

[30] Foreign Application Priority Data

| | | | |
|---|---|---|---|
| Jun. 19, 1987 | [JP] | Japan | 62-152703 |
| Oct. 31, 1987 | [JP] | Japan | 62-276068 |
| Oct. 31, 1987 | [JP] | Japan | 62-276069 |
| Oct. 31, 1987 | [JP] | Japan | 62-276071 |

[51] Int. Cl.[5] ..... G09G 5/00

[52] U.S. Cl. ..... 340/771; 340/789; 340/798; 340/799; 382/47

[58] Field of Search ..... 340/716, 717, 723, 731, 340/750, 771, 789, 798, 799; 382/44, 47, 41; 365/229; 455/343

[56] References Cited

U.S. PATENT DOCUMENTS

| | | | |
|---|---|---|---|
| 3,928,845 | 12/1975 | Clark | 340/731 |
| 4,121,283 | 10/1978 | Walker | 340/750 |
| 4,399,524 | 8/1983 | Muguruma et al. | 365/229 |
| 4,422,163 | 12/1983 | Oldenkamp | 365/229 |
| 4,454,593 | 6/1984 | Fleming et al. | 340/723 |
| 4,536,856 | 8/1985 | Hiroishi | 340/716 |
| 4,566,005 | 1/1986 | Apperley et al. | 340/771 |
| 4,574,279 | 3/1986 | Roberts | 340/731 |
| 4,611,203 | 9/1986 | Criscimagna et al. | 340/771 |
| 4,628,534 | 12/1986 | Marshall | 382/41 |
| 4,730,186 | 3/1988 | Koga et al. | 340/708 |
| 4,751,502 | 6/1988 | Ishii et al. | 340/709 |
| 4,760,387 | 7/1988 | Ishii et al. | 340/716 |
| 4,763,279 | 8/1988 | Kellam et al. | 340/731 |
| 4,764,975 | 8/1988 | Inoue | 382/47 |
| 4,769,852 | 9/1988 | Hashimoto et al. | 340/731 |

OTHER PUBLICATIONS

"EGA Wonder", PC Magazine, vol. 6, No. 3, Feb. 10, 1987.

"IBM Enhanced Graphics Adapter", Aug. 2, 1984, pp. 1–75.

Operation Manual-Egawonder, Edition 1.1, Jan. 1987, pp. 1–37.

*Primary Examiner*—Jeffery A. Brier
*Assistant Examiner*—Richard Hjerpe
*Attorney, Agent, or Firm*—Finnegan, Henderson, Farabow, Garrett, and Dunner

[57] ABSTRACT

An access to a CGA I/O port or an EGA I/O port by a CPU is detected by an NMI generator. The NMI generator then supplies an interrupt signal to the CPU. The CPU accesses an I/O monitor RAM, and detects the accessed I/O port. The CPU refers to a CGA/EGA display flag, and when the accessed I/O port is different from a display mode set in the flag, the CPU sets a display mode corresponding to the accessed I/O port in the CGA/EGA display flag. The CPU sets, in a display timing register, a display timing parameter corresponding to the display mode set in the flag.

21 Claims, 7 Drawing Sheets

FIG. 2A
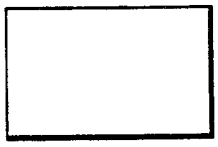
720 X 400 DOTS
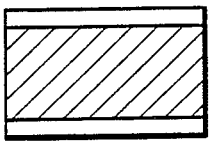
720 X 350 DOTS
FIG. 2B
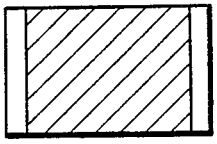
640 X 400 DOTS
FIG. 2C
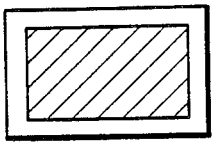
640 X 350 DOTS
FIG. 2D
FIG. 3A
HORIZONTAL SYNC. SIGNAL
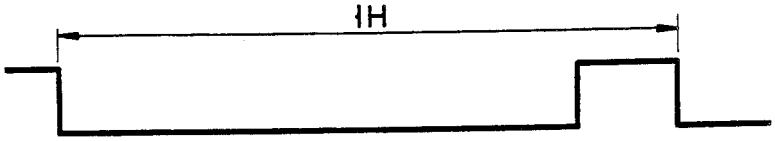
FIG. 3B
VIDEO SIGNAL
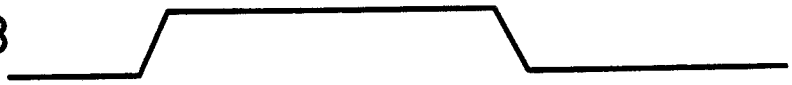
FIG. 3C
VERTICAL SYNC. SIGNAL
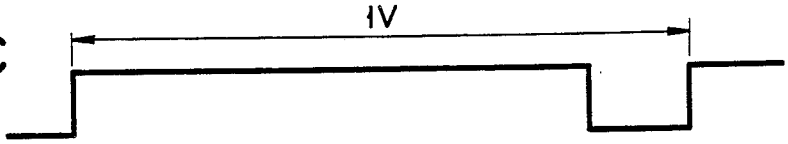
FIG. 3D
VIDEO SIGNAL
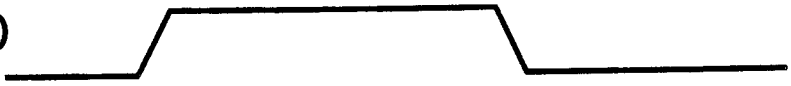
FIG. 4
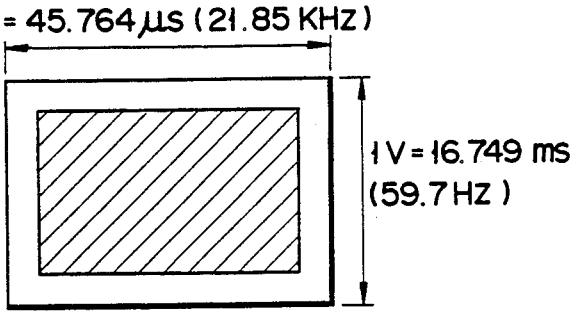

VERTICAL SYNC. END
VERTICAL SYNC. START
HORIZONTAL SYNC. END
HORIZONTAL SYNC. START
tV = 17.97 ms
tH = 43.1 μs
FIG. 5A VERTICAL SYNC. SIGNAL
FIG. 5B HORIZONTAL SYNC. SIGNAL
FIG. 5C VIDEO SIGNAL
FIG. 5D HORIZONTAL SYNC. SIGNAL
FIG. 5E VIDEO SIGNAL
FIG. 5F SYSTEM CLOCK SIGNAL

DISPLAY MODE SWITCHING SYSTEM FOR FLAT PANEL DISPLAY APPARATUS

BACKGROUND OF THE INVENTION

1. Field of the Invention

The present invention relates to a display mode switching system for a flat panel display apparatus.

2. Description of the Related Art

A flat panel display apparatus, such as a plasma display apparatus, is employed as a display apparatus for a personal computer such as a lap-top computer. For a conventional plasma display apparatus, two display adapters are included as standard equipment. One is a color graphic adapter (to be referred to as a CGA hereinafter), and the other is an enhanced color graphic adapter (to be referred to as an EGA hereinafter). The CGA and EGA are formed on, e.g., boards. A conventional plasma display apparatus has a slot for receiving one of CGA and EGA boards Therefore, a user must insert one of the CGA and EGA boards in correspondence with the display function provided by an application program to be used.

However, in the conventional plasma display apparatus, when an EGA application program (i.e. an application program providing an EGA display function) is to be executed when a CGA board is connected, it cannot be executed. Therefore, a demand has arisen for a plasma display apparatus which can provide correct display operations for a loaded application program regardless of whether the loaded application program is a CGA or EGA application program.

SUMMARY OF THE INVENTION

It is an object of the present invention to provide a display mode switching system for a flat panel apparatus, which can automatically or manually switch between CGA and EGA display modes when either a CGA or a EGA application program is executed in the plasma display apparatus having CGA and EGA boards.

According to the present invention, in order to achieve the above object, there is provided a display mode switching system for a flat panel display apparatus which has a plurality of display modes and selectively executes one of the plurality of display modes, comprising display timing parameter memory means for storing a display timing parameter of one of the display modes; display mode selection signal generating means for generating a signal for selecting one of the display modes; and display timing parameter setting means for setting, in the display timing parameter memory means, the display timing parameter of the display mode which is requested to be selected, in response to the display mode selection signal.

According to the present invention, the flat panel display apparatus comprises both the CGA and EGA boards. Therefore, even if a display mode is switched in accordance with an application program, the display mode can be switched automatically or by inputting a command. Therefore, a cumbersome operation, i.e., replacement of a board like in a conventional apparatus, need not be performed.

BRIEF DESCRIPTION OF THE DRAWINGS

Other objects and features of the present invention will be apparent from the following description taken in connection with the following drawings in which:

FIGS. 2A through 2D are views showing formats of display screens of different display resolutions;

FIGS. 3A through 3D are timing charts of control signals in a CRT display apparatus;

FIG. 4 is a view showing one horizontal and vertical periods in the CRT display apparatus;

FIGS. 5A through 5F are timing charts of control signals in a plasma display apparatus;

DETAILED DESCRIPTION OF THE PREFERRED EMBODIMENTS

Figure 1:
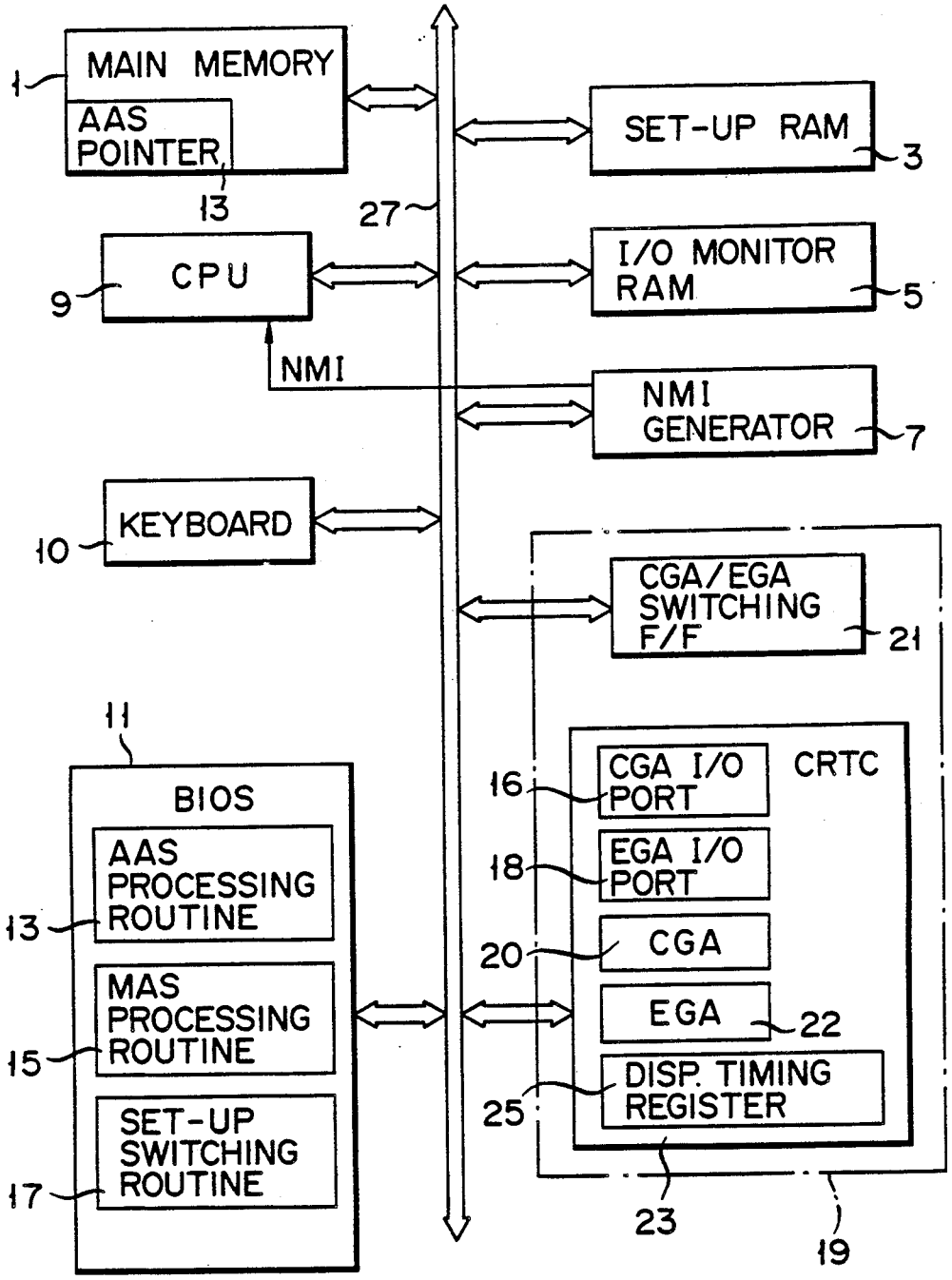
FIG. 1 is a block diagram showing an embodiment of a display mode switching system for a plasma display apparatus according to the present invention.

FIG. 1 is a block diagram showing an embodiment of a display control system for a flat panel display apparatus according to the present invention. Referring to FIG. 1, main memory 1 has a pointer for indicating a start address of AAS processing (to be described later). The AAS pointer is a start address of an AAS processing routine of a basic input/output system program (BIOS). Set-up random access memory (RAM) 3 stores CGA or EGA information input at keyboard 10. Set-up RAM 3 is backed up by a battery. Therefore, even if a main power switch is turned off, the content of the set-up RAM is not erased. Input/output (I/O) monitor RAM 5 stores an input/output write (I/O W) signal output from central processing unit 9 (CPU) onto system bus 27. NMI generator 7 determines whether control data has been written in CGA and EGA I/O ports 16 and 18. If the control data has been written, NMI generator 7 supplies a non maskable interrupt signal to CPU 9. BIOS 11 is constituted by a read only memory (ROM). BIOS 11 has AAS processing routine 13 shown in FIG. 7, MAS processing routine 15 shown in FIG. 8, and set-up processing routine 17 shown in FIG. 9.

Display subsystem 19 is a flat panel display apparatus, e.g., a plasma display apparatus, and comprises CGA/EGA switching flip-flop 21 for selectively displaying CGA and EGA display modes, and cathode ray tube 23 (CRT) controller (to be referred to as a CRTC hereinafter) In this embodiment, a CRT display unit may optionally be connected to system bus 27, and can be display-controlled by CRTC 23. CRTC 23 comprises color graphic adapter 20 (CGA), CGA I/O port 16, enhanced color graphic adapter 22 (EGA), EGA I/O port 18, and display timing register 25. Display timing parameters in a CGA mode of the CRT and plasma displays and in an EGA mode of the plasma display are set in display timing register 25. The display timing parameters are changed in correspondence with differing display apparatuses such as CRT and plasma displays and a difference of display modes such as the CGA and EGA modes. More specifically, display resolutions are different in different display modes. Therefore, in a plasma display apparatus, the format of a display screen must be changed, as shown in FIGS. 2A through 2D. FIG. 2A shows a physical display screen of a plasma display apparatus when a dot matrix corresponds to 720×400 dots. When a display resolution corresponds to 720×350 dots, the format of a display screen is as shown in FIG. 2B. When a display resolution corresponds to 640×400 dots, the format of a display screen is as shown in FIG. 2C. When a display resolution corresponds to 640×350 dots, the format of a display screen is as shown in FIG. 2D. The display timing parameters must be changed in correspondence with the changes of the display screen.

Figure 6:
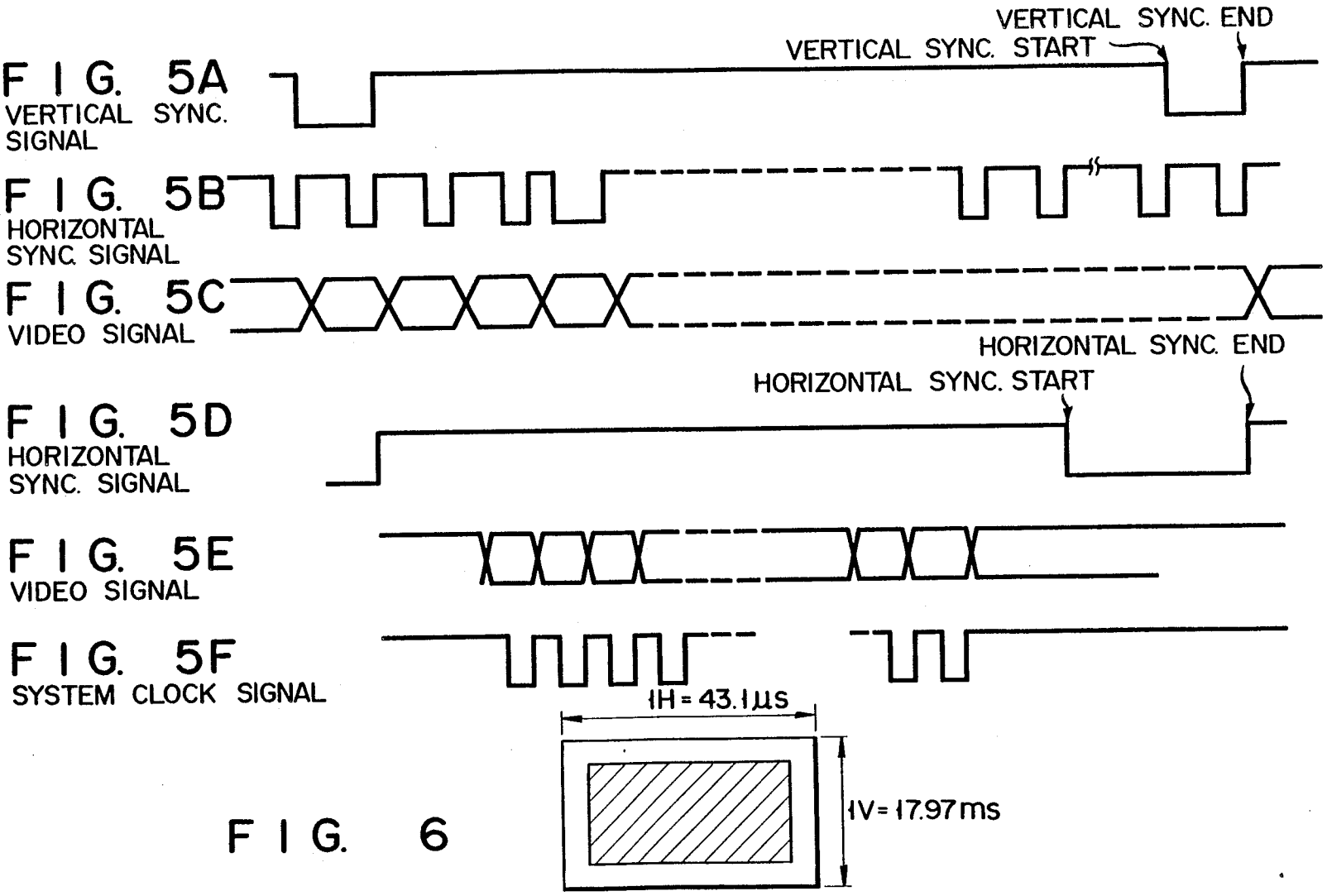
FIG. 6 is a view showing one horizontal and vertical periods in the plasma display apparatus.

As shown in FIGS. 3A through 3D and FIGS. 5A through 5D, since the CRT and plasma displays have different sync signal timings, the parameters are set as follows. In the CRT display, one horizontal period is set to be 1H=45.764 μs (21.85 kHz), as shown in FIG. 4, and one vertical period is set to be 1V=16.749 ms (59.7 Hz). On the other hand, in the plasma display apparatus, horizontal and vertical sync signals are as shown in FIGS. 5A through 5F. In this case, one horizontal period is set to be 43.1 μs, as shown in FIG. 6, and one vertical period is set to be 17.97 ms.

CPU 9 controls the entire system.

Main memory 1, set-up RAM 3, I/O monitor RAM 5, NMI generator 7, display subsystem 19, BIOS 11, keyboard 10, and CPU 9 are connected to each other via system bus 27.

In this invention, the switching of the CGA and EGA modes can be performed by three methods. The first method is automatic adapter selector (AAS) processing. In the AAS processing, the CGA and EGA modes are automatically switched The second method is manual adapter selector (MAS) processing. In the MAS processing, the CGA and EGA modes are manually switched. The third method is set-up processing. In the set-up processing, when the power switch of the system is turned on, a display mode written in set-up RAM 3 is designated. When the content of set-up RAM 3 is to be updated, a desired display mode is designated at keyboard 10 to change the content of set-up RAM 3.

Figure 7:
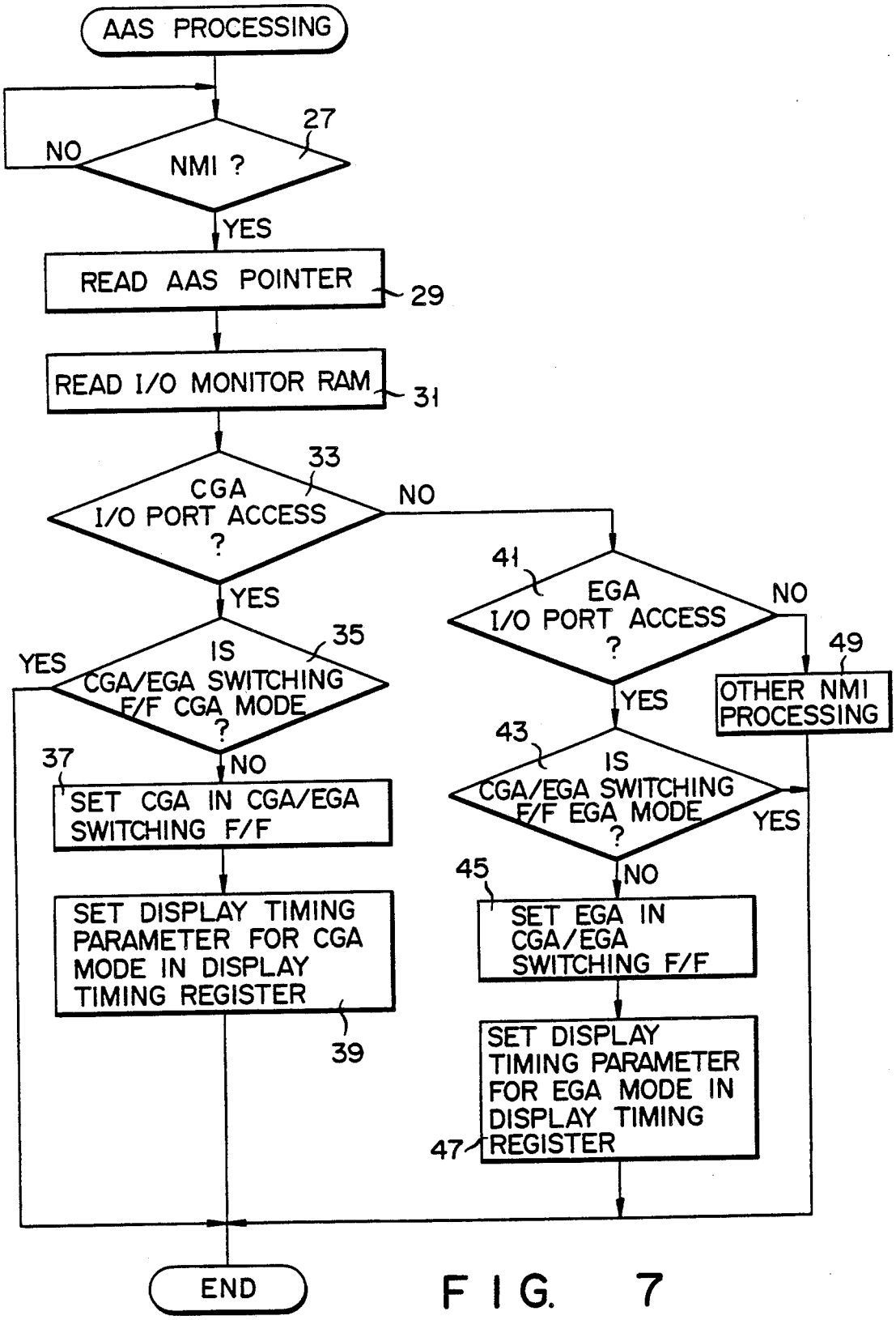
FIG. 7 is a flow chart showing AAS processing.

The AAS processing will be described with reference to the flow chart shown in FIG. 7. An application program is normally programmed so that an image is displayed in either the CGA or EGA display mode. In this case, the application program is programmed such that a CGA or an EGA display mode write signal is supplied from CPU 9 to CGA or EGA I/O port 16 or 18. Therefore, a timing is detected when CPU 9 accesses either CGA or EGA I/O port 16 or 18, and a non maskable interrupt (NMI) signal is supplied to CPU 9. Upon reception of the NMI signal, CPU 9 interrupts the currently executing job, and reads I/O monitor RAM 5. I/O monitor RAM 5 stores I/O access information from the time the power switch of the main system is turned on to the present state. Therefore, the access information can be checked so as to determine whether or not the display mode has been switched.

It is then determined in step 27 whether the NMI signal has been supplied from NMI generator 7. If YES in step 27, CPU 9 reads AAS pointer 13 in main memory 1 in step 29. The start address of the AAS processing routine is set in AAS pointer 13. Therefore, the start address is set in a program counter (not shown), thereby executing the AAS processing routine. In the AAS processing routine, CPU 9 reads I/O monitor RAM 5 in step 31. I/O monitor RAM 5 stores information indicating one of CGA and EGA I/O ports 16 and 18 which has been accessed by CPU 9. Therefore, it is determined in step 33 whether CGA I/O port 16 has been accessed. If YES in step 33, it is then determined in step 35 whether CGA/EGA switching F/F 21 has been set in the CGA display mode. If YES in step 35, switching is not required, and the AAS processing is ended. However, if NO in step 35, CGA/EGA switching F/F 21 is set in the CGA display mode in step 37. In step 39, a timing parameter for the CGA display mode is set in display timing register 25 in CRTC 23.

However, if it is determined in step 33 that CGA I/O port 16 has not been accessed, it is then determined in step 41 whether or not 41 EGA I/O port 18 has been accessed. If NO in step 41, other NMI processing is performed in step 49. However, if YES in step 41, it is checked in step 43 whether CGA/EGA switching F/F 21 has been set in the EGA display mode. If YES in step 43, switching is not required, and the AAS processing is ended. However, if NO in step 43, CGA/EGA switching F/F 21 is set in the EGA display mode in step 45. In step 47, a timing parameter for the EGA display mode is set in display timing register 25. As a result, CRTC 23 display-controls the plasma display apparatus in accordance with the display timing parameter set in display timing register 25.

Figure 8:
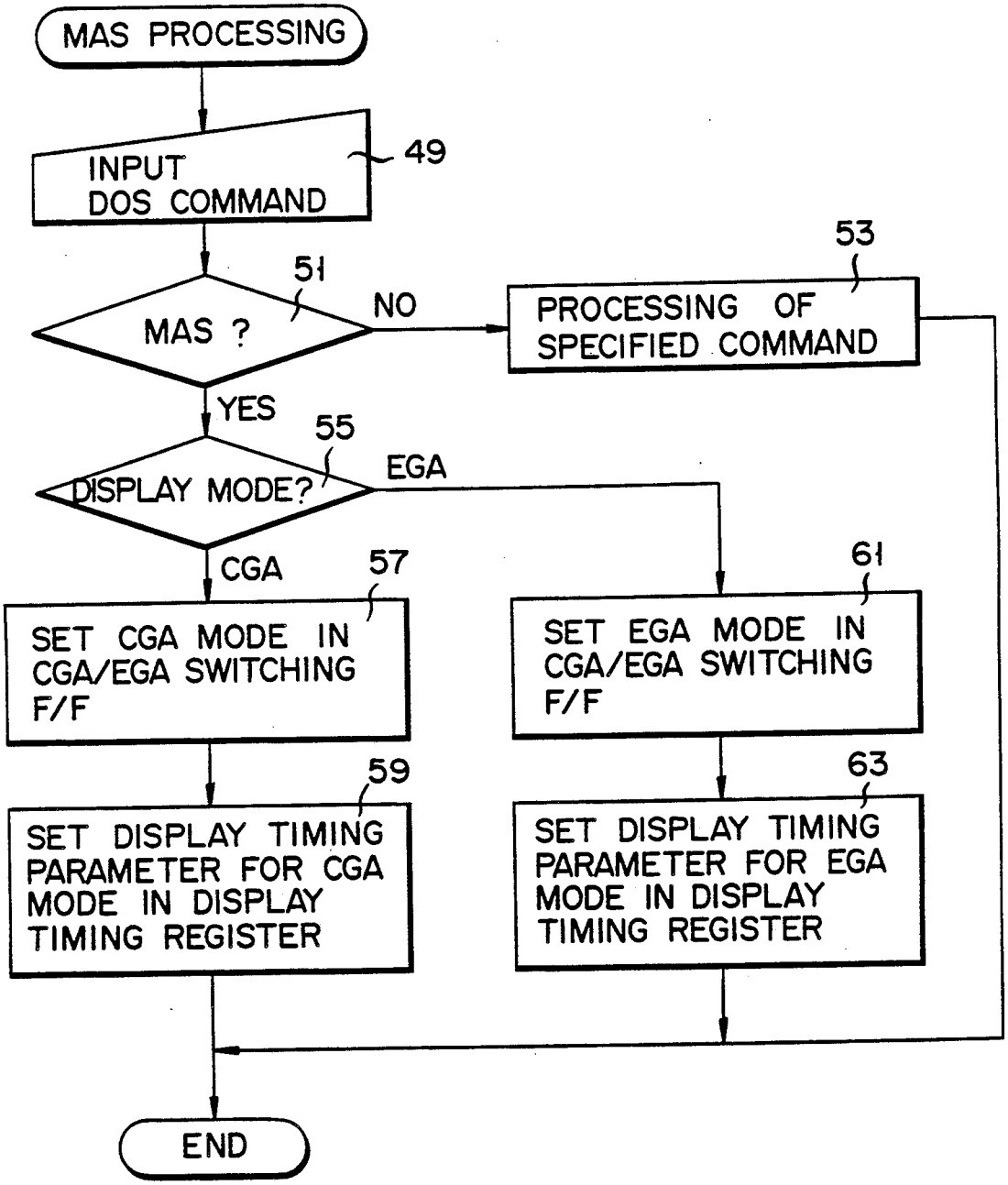
FIG. 8 is a flow chart showing MAS processing.

A case will be described with reference to the flow chart of MAS processing shown in FIG. 8, wherein the CGA and EGA display modes are manually switched.

In the MAS processing, a command (e.g., "MASCGA" or "MASEGA") which can be operated on a disk operating system (DOS) is provided. A user inputs the DOS command to switch the display mode.

More specifically, in step 49, CPU 9 receives the DOS command input at keyboard 10. It is determined in step 51 whether or not the input DOS command is for the MAS processing. If NO in step 51, CPU 9 executes processing in accordance with the input DOS command in step 53.

However, if YES in step 51, the display mode is determined in step 55. In step 57, the CGA display mode is set in CGA/EGA switching F/F 21. In step 59, a display timing parameter for the CGA display mode is set in display timing register 25.

If the EGA display mode is detected in step 55, the EGA display mode is set in CGA/EGA switching F/F 21 in step 61. In step 63, a display timing parameter for the EGA display mode is set in display timing register 25. The MAS processing has the same effect as the AAS processing described above. In the AAS processing, each time CGA or EGA I/O port 16 or 18 is accessed, the processing shown in FIG. 6 is executed, and this processing takes a slightly longer period of time than that of the MAS processing. When the application program is programmed to correspond to both the CGA and EGA modes, the AAS processing cannot often determine what about the display modes. In this case, the MAS processing is more effective.

The set-up processing will be described below.

In the set-up processing, either display mode (in this embodiment, the CGA display mode) is written in advance in set-up RAM 3. Therefore, when the power switch of the main system is turned on, CPU 9 reads the contents of set-up RAM 3. Then, CPU 9 sets a display mode in CGA/EGA switching F/F 21 and sets a display timing parameter in display timing register 25 in accordance with the read content. When a display mode has been temporarily switched, a user can rewrite the contents of set-up RAM 3. This rewrite operation can be achieved by providing a DOS command for switching the contents of set-up RAM 3. Alternatively, a CGA/EGA selection menu can be displayed on the display screen, and selection information may be input at the keyboard. After the display mode has been temporarily rewritten, the initial display mode can be resumed after the system has been reset.

Figure 9:
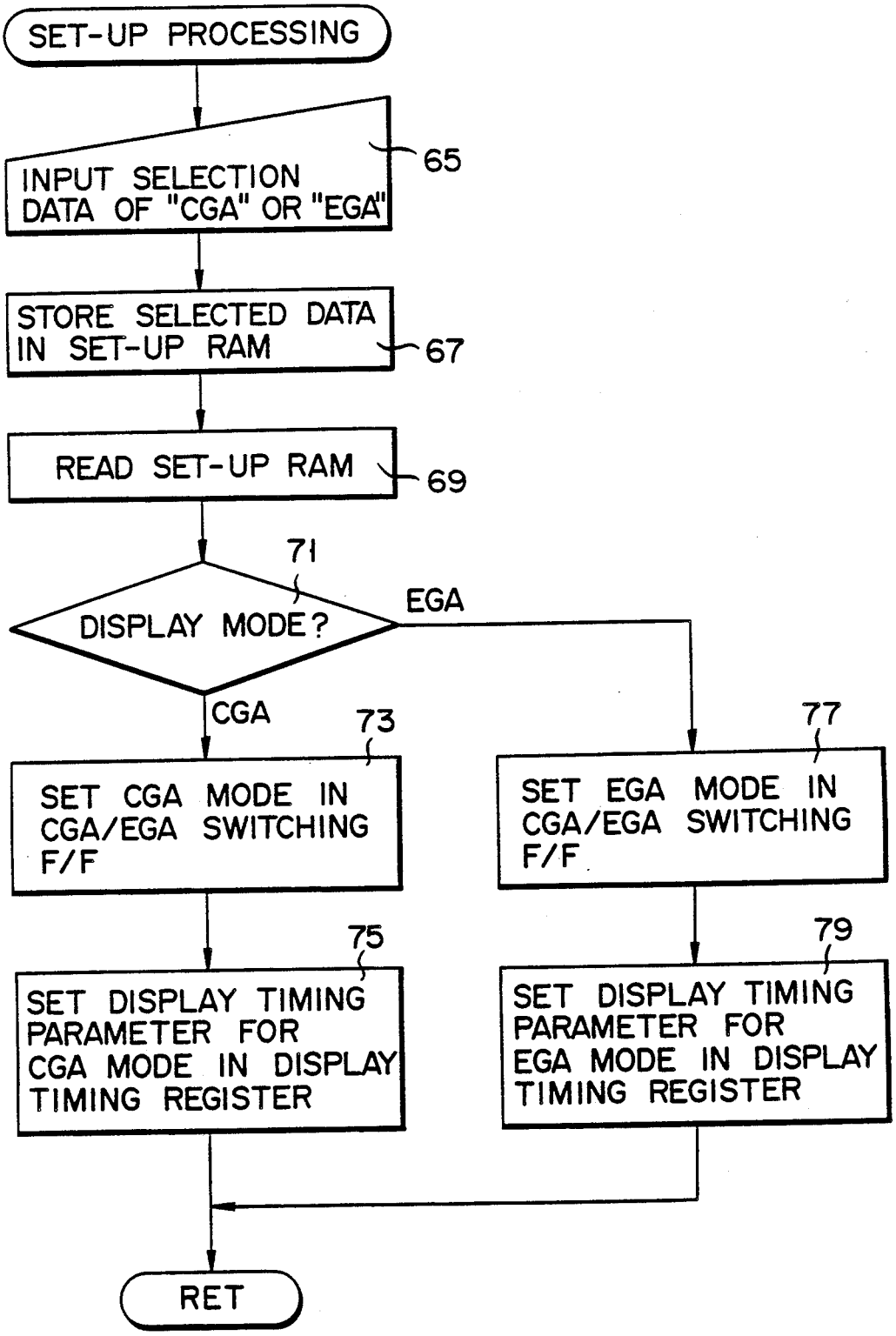
FIG. 9 is a flow chart showing set-up processing.

More specifically, in step 65 of the set-up processing flow chart shown in FIG. 9, the CGA or EGA display mode is input at keyboard 10. In step 67, CPU 9 stores one of input CGA and EGA display mode data in set-up RAM 3. In step 69, CPU 9 reads the contents of set-up RAM 3. It is determined in step 71 whether the contents of set-up RAM 3 corresponds to the CGA or EGA display mode. If the CGA display mode is detected, CGA/EGA switching F/F 21 is set in the CGA display mode in step 73. In step 75, a timing parameter for the CGA display mode is set in display timing register 25. If the EGA display mode is detected in step 71, CGA/EGA switching F/F 21 is set in the EGA display mode in step 77. In step 79, a timing parameter for the EGA display mode is set in display timing register 25.

Figure 10:
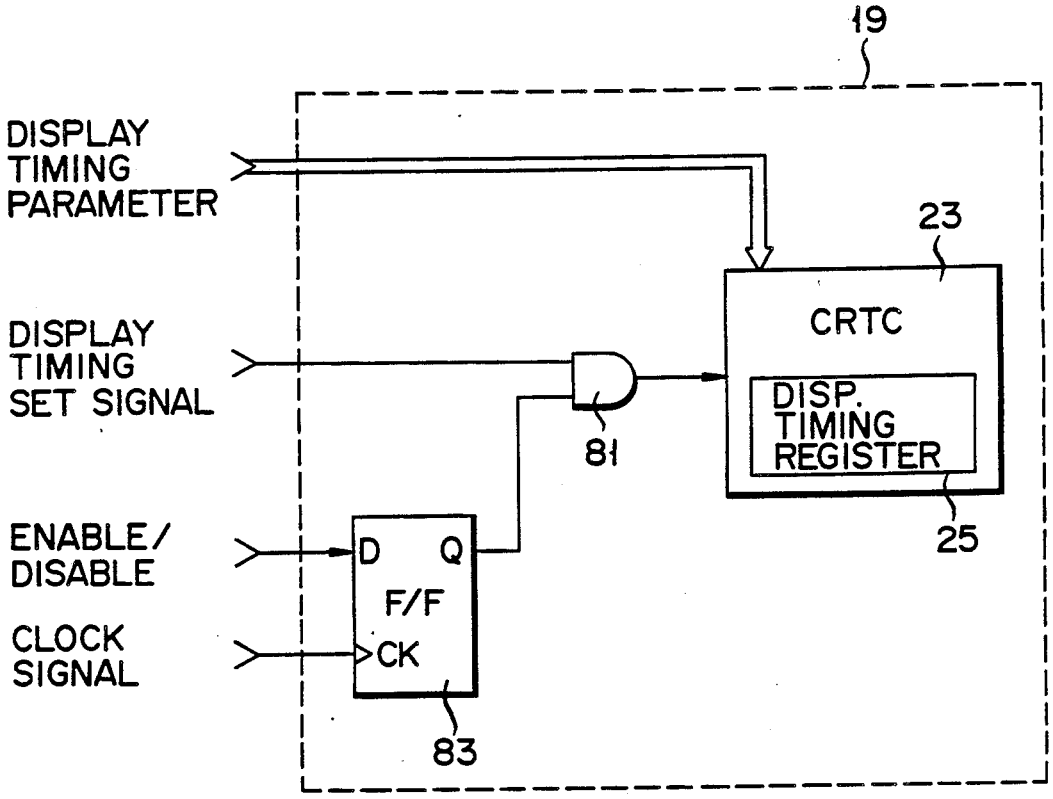
FIG. 10 is a circuit diagram of a protect mechanism which inhibits updating of a content of a display timing register after a CGA or EGA display timing parameter is set in the display timing register

In this manner, after the display timing parameter has been set in display timing register 25, the contents of the display timing parameter must be kept unchanged until the application program has been executed. A protect mechanism for inhibiting the changing of the parameter will be described with reference to the circuit diagram of FIG. 10. FIG. 10 is a partially detailed circuit diagram of plasma display apparatus 19 shown in FIG. 1. When the CGA or EGA display timing parameter is set in display timing register 25, CPU 9 supplies it to register 25 through system bus 27. CPU 9 supplies a display timing set signal to one input terminal of AND gate 81, and supplies an enable signal to a D input terminal of protect flip-flop 83. Then, protect F/F 83 supplies the enable signal to AND gate 81 in synchronism with a clock signal supplied from a clock signal generator (not shown). As a result, AND gate 81 supplies a display timing set signal to CRTC 23. In response to the display timing set signal, CRTC 23 sets the CGA or EGA display timing parameter in display timing register 25.

When the display timing parameter is set in register 25, CPU 9 supplies a disable signal to protect F/F 83. As a result, the disable signal from protect F/F 83 is continually supplied to the other input terminal of AND gate 81 until the corresponding application program has been executed. Therefore, if a new display timing parameter is set in register 25, it will be blocked by AND gate 81.

What is claimed is:

1. A display mode switching system for a flat panel display apparatus and an optional CRT display apparatus, each operable in a selected one of a plurality of display modes in accordance with a corresponding display timing parameter, each display timing parameter corresponding to a specified resolution, the system comprising:

display timing parameter memory means for storing a display timing parameter corresponding to one of the plurality of display modes;

designating means for designating one of the plurality of display modes as a selected display mode; and means for setting, in said display timing parameter memory means, the display timing parameter corresponding to the selected display mode.

2. A system according to claim 1, further comprising a central processing unit (CPU), and wherein said designating means comprises detection means for detecting one of the plurality of display modes accessed by said CPU in accordance with a display mode defined by an application program executed on said CPU, and means for designating the display mode detected by said detection means as the selected display mode.

3. A system according to claim 1, wherein said designating means comprises input means for inputting information indicating one of the plurality of display modes as the selected display mode, and means for designating the selected display mode in accordance with the information from said input means.

4. A system according to claim 3, wherein the information indicating one of the plurality of display modes is a command executed in a disk operating system program.

5. A system according to claim 1, wherein said designating means comprises display mode information memory means for storing display mode information indicating a display mode to be selected when a power switch of said system is turned on, and means for retrieving the contents of said display mode information memory means and for designating a display mode corresponding to the retrieved contents when the power switch of said system is turned on.

6. A system according to claim 5, further comprising input means for inputting information indicating one of the plurality of display modes, and means for rewriting display mode information in said display mode information memory means in accordance with the display mode information input by said input means.

7. A system according to claim 1, further comprising inhibition means for inhibiting the contents of said display timing parameter memory means from being changed by said means for setting the display timing parameter after the display timing parameter has been set in said display timing parameter memory means.

8. A system according to claim 1, wherein the plurality of display modes comprises at least a color graphic adapter (CGA) mode and an enhanced color graphic adapter (EGA) mode.

9. A display mode switching system for a flat panel display apparatus and an option CRT display apparatus operable in selected ones of a plurality of display modes, in accordance with a corresponding display timing parameter, as defined by an application program, each display timing parameter corresponding to a specified resolution, the system comprising:

a CPU operable to execute an application program and to access selected ones of the display modes as defined by the executed application program;

display timing parameter memory means for storing a display timing parameter of the selected display mode;

display mode detection means for detecting a display mode accessed by said CPU, and for outputting a detection signal; and display mode switching means for setting, in said display timing parameter memory means, the display timing parameter for said flat panel display apparatus corresponding to the detected display mode in response to the detection signal from said display mode detection means.

10. A system according to claim 9, further comprising inhibition means for inhibiting the contents stored in said display timing parameter memory means from being changed by said display mode switching means after the display timing parameter has been set in said display timing parameter memory means by said display mode switching means.

11. A system having at least a color graphic adapted (CGA), a CGA I/O port, an enhanced color graphic adapted (EGA), and an EGA I/O port for switching a display mode of a flat panel display apparatus and an optional CRT display apparatus in accordance with an application program, comprising:

a CPU for executing said application program, for accessing the CGA and EGA I/O ports, and for generating an input/output write signal;

access information memory means for storing the input/output write signal;

display mode flag means for indicating whether a present display mode is a CGA or an EGA display mode;

display timing parameter memory means for storing a display timing parameter corresponding to a specified resolution; and access detection means for detecting that the CGA or the EGA I/O port has been accessed by said CPU and for supplying an interrupt signal to said CPU, wherein said CPU refers to said access information memory means in response to the interrupt signal so as to detect if the access has been made to said CGA I/O port or to said EGA I/O port and to determine if the access information in the detected I/O port corresponds to the content of said display mode flag means, and wherein if the access information of the detected I/O port does not correspond to the content of said display mode flag means, said CPU sets said display mode flag means in a new display mode and sets a display timing parameter corresponding to the said new display mode in said display timing parameter memory means.

12. A system according to claim 11, further comprising inhibition means for inhibiting the contents stored in said display timing parameter memory means from being changed by said CPU after said CPU sets the display timing parameter in said display timing parameter memory means.

13. A display mode switching system for a flat panel display apparatus and an optional CRT display apparatus each operable in selected ones of a plurality of display modes in accordance with a corresponding display timing parameter, each display timing parameter corresponding to a specified resolution, the system comprising:

display timing parameter memory means for storing a display timing parameter corresponding to one of the plurality of display modes;

input means for inputting information indicating one of the plurality of display modes; and means for setting, in said display timing parameter memory means, the display timing parameter for said flat panel display apparatus corresponding to the display mode indicating information input from said input means.

14. A system according to claim 13, wherein the contents stored in said display timing parameter memory means are inhibited from being changed by said means for setting the display timing parameter after the display timing parameter has been set in said display timing parameter memory means.

15. A system according to claim 13, wherein the information indicating one of the plurality of display modes is a command executed in a disk operating system program.

16. A system having at least a color graphic adapted (CGA) and an enhanced color graphic adapted (EGA), for switching a display mode of a flat panel display apparatus and an optional CRT display apparatus in accordance with a disk operating system (DOS) command, each of the display modes operating in accordance with a corresponding display timing parameter, each display timing parameter corresponding to a specified resolution, the system comprising:

input means for inputting the DOS command for designating one of CGA and EGA display modes;

display timing parameter memory means for storing a display timing parameter corresponding to the CGA or a display timing parameter corresponding to the EGA;

DOS command decoding means for decoding the DOS command input from said input means and for outputting a CGA or an EGA designation signal; and display timing parameter setting means for storing, in said display timing parameter memory means, the display timing parameter corresponding to the display mode designated by said DOS command decoding means.

17. A system according to claim 16, further comprising inhibition means for inhibiting the contents stored in said display timing parameter memory means from being changed by said display timing parameter setting means after said display timing parameter setting means has set the display timing parameter in said display timing parameter memory means.

18. A display mode switching system for a flat panel display apparatus and an optional CRT display apparatus each operable in selected ones of a plurality of display modes in accordance with a corresponding display timing parameter and which selectively executes one of the plurality of display modes, each display timing parameter corresponding to a specified resolution, the system comprising:

display mode information memory means for storing display mode information indicating which display mode is to be selected when a power switch of said system has been turned on;

display timing parameter memory means for storing a display timing parameter corresponding to the selected display mode;

display mode flag means indicating a present display mode; and display mode setting means for, after the power switch of said system has been turned on, reading the contents of said display mode information memory means, setting the contents in said display mode flag means, and setting the display timing parameter for said flat panel display apparatus corresponding to the display mode in said display timing parameter memory means.

19. A system according to claim 18, further comprising input means for inputting information indicating one of the plurality of display modes, and means for rewriting the display mode information in said display mode information memory means in accordance with the display mode information input by said input means.

20. A system according to claim 18, wherein said display mode information memory means comprises a random access memory (RAM) which can be backed up by a battery when the power switch of said system is turned off.

21. A system according to claim 18, further comprising inhibition means for inhibiting the contents stored in said display timing parameter memory means from being changed by said display mode setting means after the display timing parameter has been set in said display timing parameter memory means.

* * * * *